US007425148B1

(12) United States Patent
Allen

(10) Patent No.: US 7,425,148 B1
(45) Date of Patent: Sep. 16, 2008

(54) FIXTURE OF A CORD HOLDER HAVING A PAIR OF KNOBS AND A FINGER

(76) Inventor: Robert S. Allen, P.O. Box 4964, Key West, FL (US) 33041

( * ) Notice: Subject to any disclaimer, the term of this patent is extended or adjusted under 35 U.S.C. 154(b) by 0 days.

(21) Appl. No.: 11/893,219

(22) Filed: Aug. 14, 2007

Related U.S. Application Data

(60) Provisional application No. 60/837,144, filed on Aug. 14, 2006.

(51) Int. Cl.
*H01R 13/62* (2006.01)

(52) U.S. Cl. ..... 439/369; 439/458; 439/471

(58) Field of Classification Search ..... 439/369, 439/370, 470, 471, 367, 368, 457, 458, 463; 39/371

See application file for complete search history.

(56) References Cited

U.S. PATENT DOCUMENTS

| | | | | |
|---|---|---|---|---|
| 4,183,603 | A * | 1/1980 | Donarummo | 439/369 |
| 4,875,874 | A | 10/1989 | Windsor, Jr. | |
| 5,336,107 | A | 8/1994 | Sheryll | |
| 5,393,243 | A | 2/1995 | Carmo | |
| 5,423,693 | A | 6/1995 | Light | |
| 5,505,634 | A | 4/1996 | Osten | |
| 5,582,524 | A | 12/1996 | Sanner et al. | |
| 5,591,046 | A | 1/1997 | Klein et al. | |
| 6,135,803 | A | 10/2000 | Kovacik et al. | |
| 6,158,095 | A | 12/2000 | Lassiter | |
| 6,217,366 | B1 | 4/2001 | Weisstock | |
| 6,319,044 | B1 | 11/2001 | Stekelenburg | |
| 6,846,196 | B1 | 1/2005 | Fallon | |
| 6,948,963 | B2 | 9/2005 | Burton | |
| 7,081,004 | B1 * | 7/2006 | Puzio | 439/369 |
| 7,123,716 | B2 * | 10/2006 | Jozitis et al. | 379/438 |
| 2004/0166718 | A1 * | 8/2004 | Yoest | 439/369 |

* cited by examiner

*Primary Examiner*—Hae Moon Hyeon
(74) *Attorney, Agent, or Firm*—Ronald R. Kilponen

(57) ABSTRACT

A cord holder is shown and disclosed. The cord holder has a bridge and a fixture on each end of the bridge. The fixture has a finger on the outermost edge of the bridge which extends from one side of the bridge to the other side forming an upwardly opening saddle. A pair of knobs located adjacent to the fingers, extend from the bottom of the bridge. The arrangement of the knobs forms a downward opening curved area for housing the cord. The user inserts one cord into the saddle and the curved area on one end and the second cord into the saddle and curved area on the opposite end. The ends of the cords can then be attached and retained below the bridge in this plugged together position until removed by the users as the cords are retained preventing premature disconnect of the cords. Alternative embodiments show a cord holder either translatable or fixed to one end of the cord. Another embodiment shows multiple cord holders attached to form a multiple line extension cord.

3 Claims, 5 Drawing Sheets

FIXTURE OF A CORD HOLDER HAVING A PAIR OF KNOBS AND A FINGER

CROSS REFERENCE TO RELATED APPLICATIONS

This application claims the benefit of Provisional Application for Patent Ser. No. 60/837,144 filed on Aug. 14, 2006 hereby incorporated by reference.

FIELD

These embodiments relate to the field of electrical cord union clasping and holding devices.

BACKGROUND

Several systems have been disclosed in the past that teach separate methods used for the coupling of electrical cord-ends, male and female, so that the intended coupling union remains intact. Such background art reflects an engineering journey to provide a useful tool for those who benefit from the use of electrical tools and/or may depend upon them for their livelihood. Examples include: Lassiter; U.S. Pat. No. 6,158,095; Sanner and Wright, U.S. Pat. No. 5,582,524; Windsor, Jr., U.S. Pat. No. 4,875,874; Carmo, U.S. Pat. No. 5,393,243; Fallon, U.S. Pat. No. 6,846,196; Stekelenburg, U.S. Pat. No. 6,319,044.

SUMMARY

It is the intention of the present embodiments to provide a very useful device that has the capability of providing a clamping or holding method for multiple electrical cord sizes, as well as different shapes and sizes of cord-ends. These embodiments offer a simple, durable single piece construction that is well suited to the often rough-and-ready world of construction and/or home repair.

It is known that exterior environments where electrical cord usage occurs may often contain mud and snow. It is also known that, by nature, the type of work environments for which these electrical cord union clamps are best suited, are more often than not, abusive toward tools. An example of abuse may include being stepped on repeatedly by heavy work boots. Another example of abuse may include caking with hardened mud, ice or snow. The cords may also be pulled, either accidently or purposely, without careful removal of one cord from another.

It is also known that background art, which may be fully capable of maintaining the intended functions indoors and/or under conditions where maintenance and well cared for tools are the norm, this background art also requires the added function of durability. The examples of potential abuse illustrated above show that it is questionable that the use of swinging hinges, finely-tuned spring apparatus and/or multiple piece construction units with highly articulated attachments as shown in the background art are fit for the rough-and-ready construction world.

It is the intention of the present embodiments to overcome the design challenges and deficiencies of the background electrical cord union claspers/holders. These embodiments must be up to the challenging physical environments in which these devices often find use, and by doing so offer to the market a simple, inexpensive and low maintenance design that can be used for many years.

DETAILED DESCRIPTION OF PREFERRED EMBODIMENTS

Figure 1:
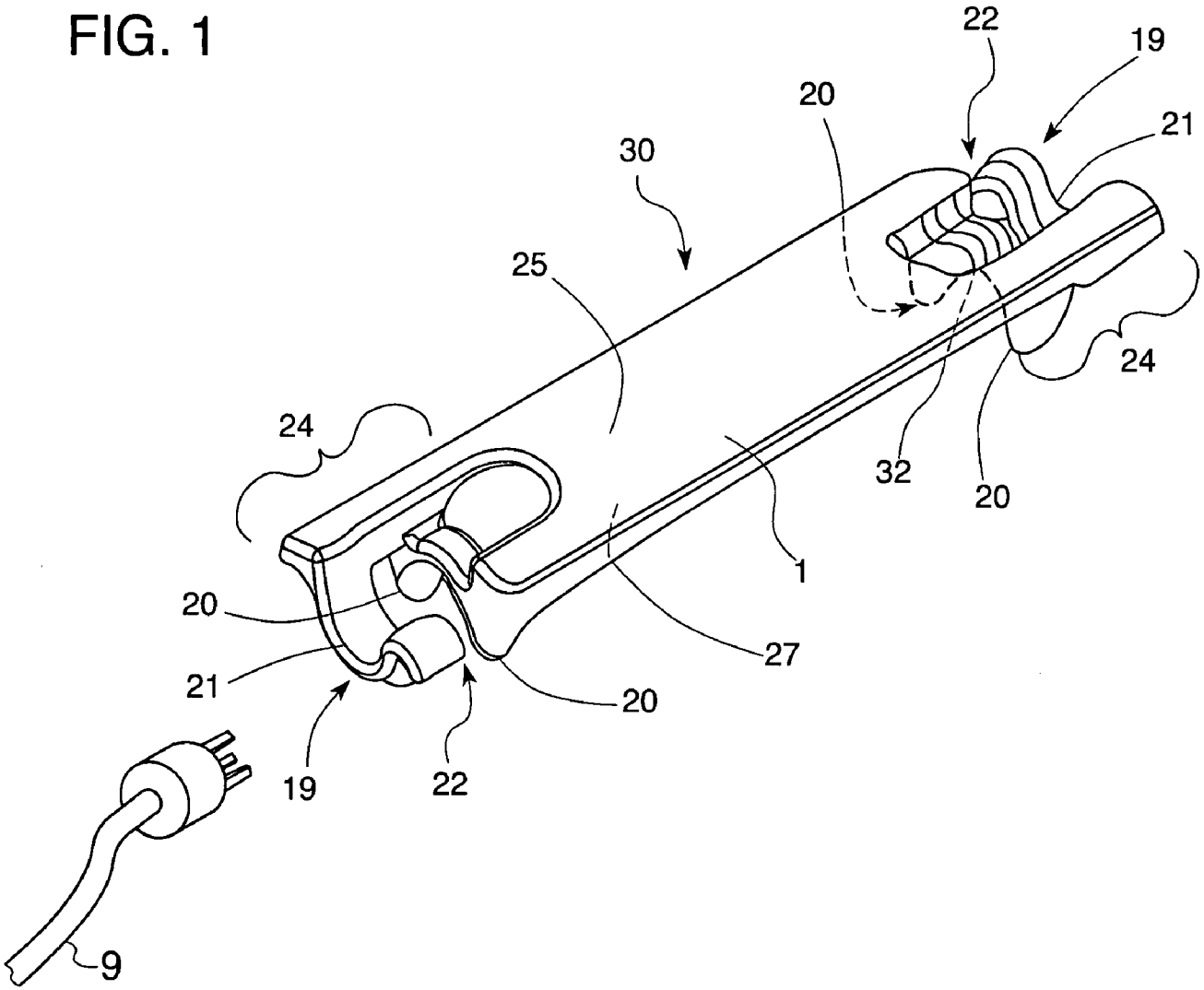
FIG. 1 shows a top perspective view of one embodiment of a cord holder.

Referring to the drawings in detail wherein like elements are indicated by like numerals, there is shown in FIG. 1 a cord holder 30. The cord holder 30 generally has a plate like shape or bridge 1 with a top 25 and a bottom 27. The cord holder 30 can be manufactured from a non-electrically conductive material such as a polymer. It may be beneficial to injection mold this device, but other manufacturing methods such as machining or adhesives may also be used.

The cord holder 30 has fixtures 24 on each end for holding the cord 9. The fixtures 24 are each formed from two elements, the knobs 20 of which there are two and a finger 19. The fingers 19 are located at the end of the bridge 1. The knobs 20 are located near or adjacent to the fingers 19 and extend from the from the bottom 27 of the bridge 1 forming a downward opening curved area 32. There is a gap 22 between the end of the fingers 19 and the knobs 20 for insertion of the cord 9 (not shown). The fingers 19 are arced from one side of the bridge 1 towards the other side of the bridge 1 forming an upwardly opening saddle 21 in approximately the center between the two ends of the fingers 19.

Figure 2:
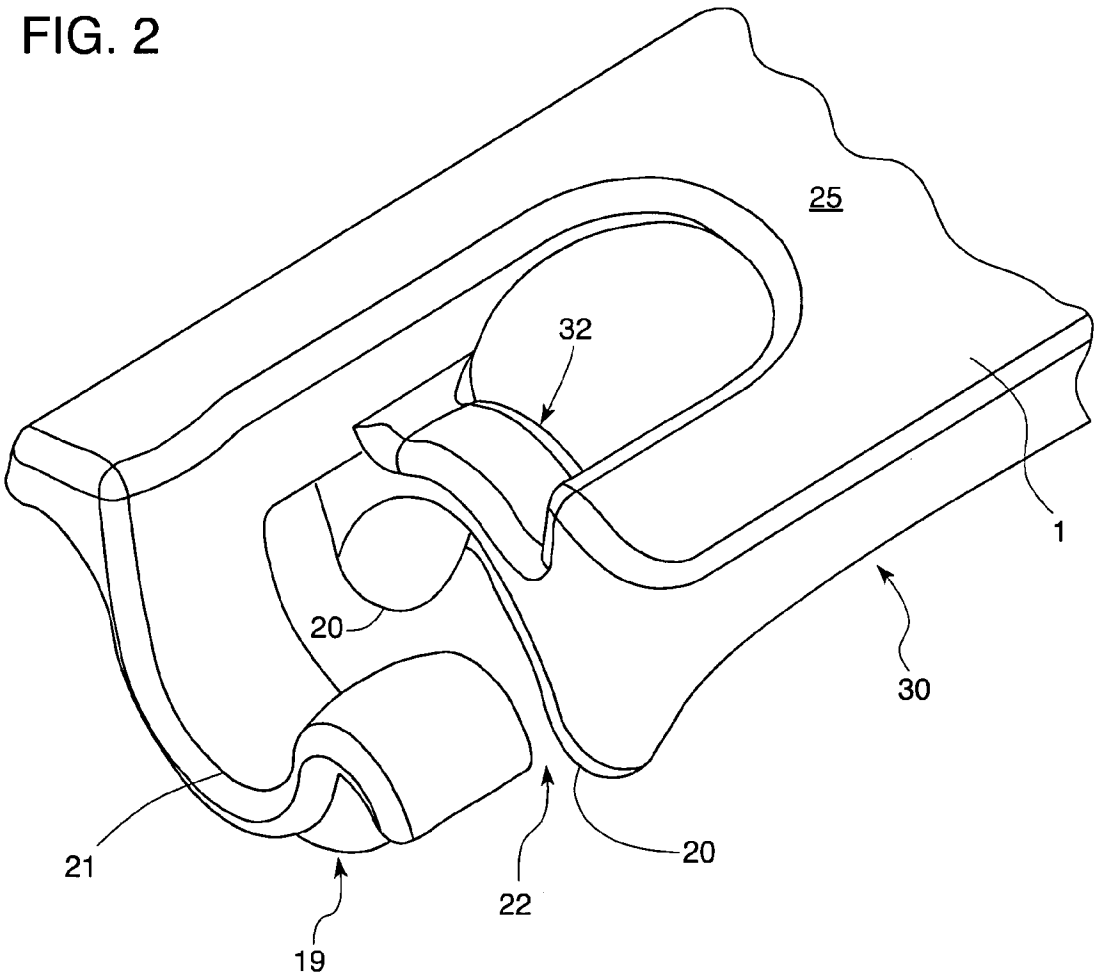
FIG. 2 shows a detailed view of one end of one embodiment of a cord holder.
Figure 3:
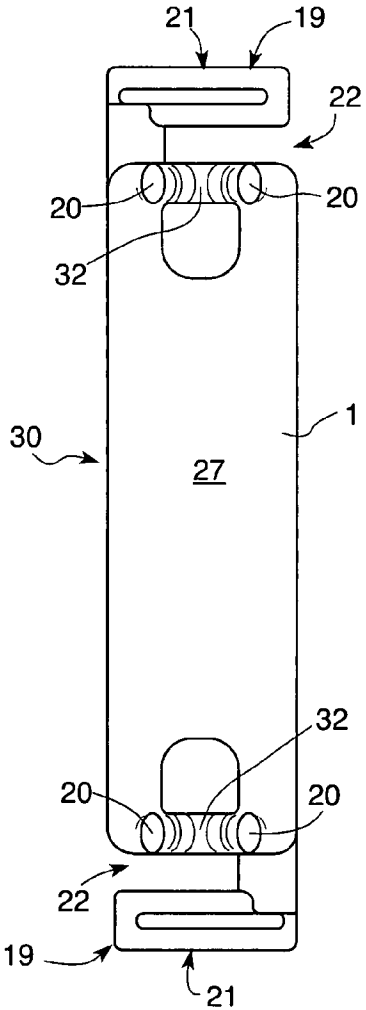
FIG. 3 shows a bottom view of one embodiment of a cord holder.

FIG. 2 shows a detailed view of one end or fixture 24 of one embodiment of the cord holder 30. FIG. 3 shows a bottom view of one embodiment of the cord holder 30. The end or fixture 24 comprises generally a pair of knobs 20 spaced apart a pre-determined distance depending upon the diameter of the cord 9 (not shown) that the cord holder 30 is designed hold. The knobs 20 are raised from the bottom of the bridge 1 forming a curved area 32. The curved area 32 generally matches the curve of the saddle 21 of the fingers 19.

Outside of the knobs 20 and on each end of the cord holder 30 bridge 1 is a finger 19. Finger 19 is flexible with a saddle 21. To install the cord 9 into the cord holder 30, the cord 9 (not shown) is inserted into the gap 22 between the knob 20 and finger 19 FIG. 2. The finger 9 can flex to allow the cord 9 to pass through the gap 22 and rest in saddle 21 and the curved area 32 between the knobs 20 where it is secured until removed by the user. The finger 19 when released biases the cord 9 towards the top 25 of the bridge 1. It should be appreciated that a more rigid finger 19 could also be utilized and this would mean that the user would need to thread the cord between the gap 22 into the saddle and the curved area 32. The finger 19 may be more rigid depending upon the type of material that the cord holder 30 is made from. The cord holder 30 would function with either a flexible finger 19 or a rigid finger 19.

A complementary end of a cord 9 (not shown) would be inserted between the finger 19 and knobs 20 on the opposite end of the bridge 1 and secured in like manner. The male and female ends (not shown) of the cord 9 would be attached to each other and located below the bridge 1 of the cord holder 30. Securing the cord 9 between the finger 19 and the knobs 20 would thus discourage the male and female ends from coming detached allowing the user to operate electrical devices uninterrupted.

The saddle 21 and design of the curved area 32 between the knobs 20 can be adjusted depending on the diameter of the cord 9. Obviously a larger diameter cord 9 would require a deeper saddle 21 and more space between the knobs 20 to accommodate this larger diameter cord 9. The spacing between the fixtures 24 or of the bridge 1 would also need to be adjusted likewise. If a cord 9 had larger or smaller ends for attachment, then the amount of space needed to affix the cords, or the length of the bridge 1 would need to be lengthened or shortened.

Figure 4:
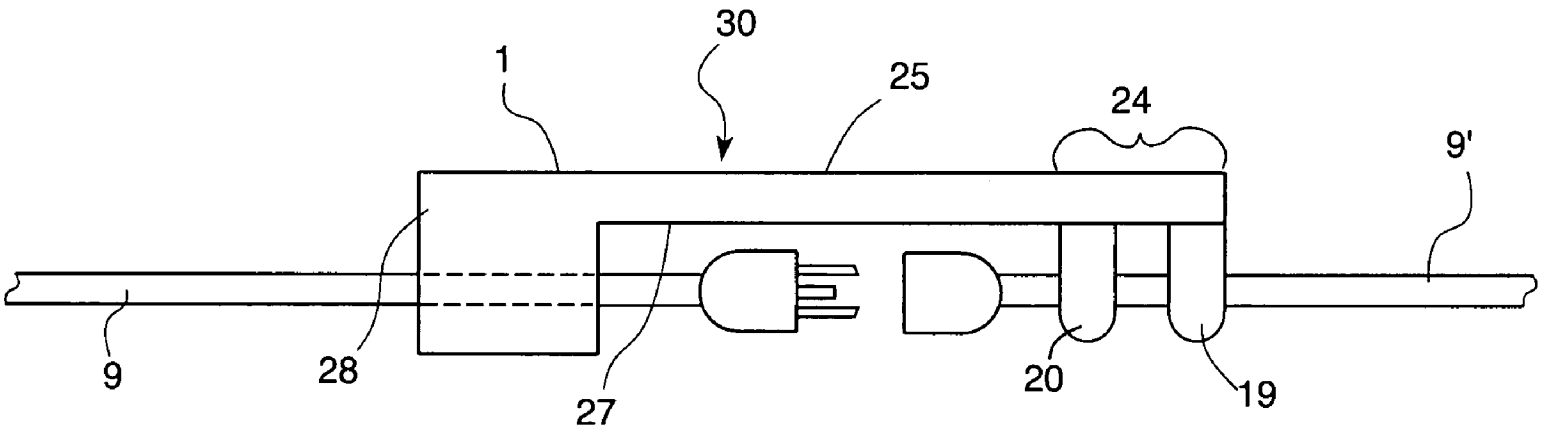
FIG. 4 shows another embodiment of the cord holder where the cord holder is attached to one end of the cord for attachment to a second cord.

FIG. 4 shows a cord holder 30 where the cord holder 30 is fixed via attachment 28 to one end of the cord 9. This embodiment is essentially a cord holder 30 cut in half and attached to a cord. The attachment 28 could be molded to the cord 9 or use another method of attachment known in the art for affixing the cord holder 30 shown to an already manufactured cord 9. The attachment 28 could also be a sliding or moving attachment. This would be beneficial if the user wanted to plug this embodiment into a wall socket. The user could slide the cord holder 30 away from the plug so that the plug could be inserted into the wall outlet (not shown).

This embodiment of the cord holder 30 has only one fixture 24 for attachment to the second cord 9'. The fixture 24, finger 19 and knobs 20 function as has been described previously. This embodiment essentially takes just one end of the previously discussed cord holder 30 and affixes it to a cord 9. This embodiment would be cheaper to manufacture while still providing the same benefit of keeping the cords 9,9' attached to one another. This embodiment may be more beneficial from the standpoint that the cord holder 30 would be less likely to be lost as it would stay attached to cord 9.

Figure 5:
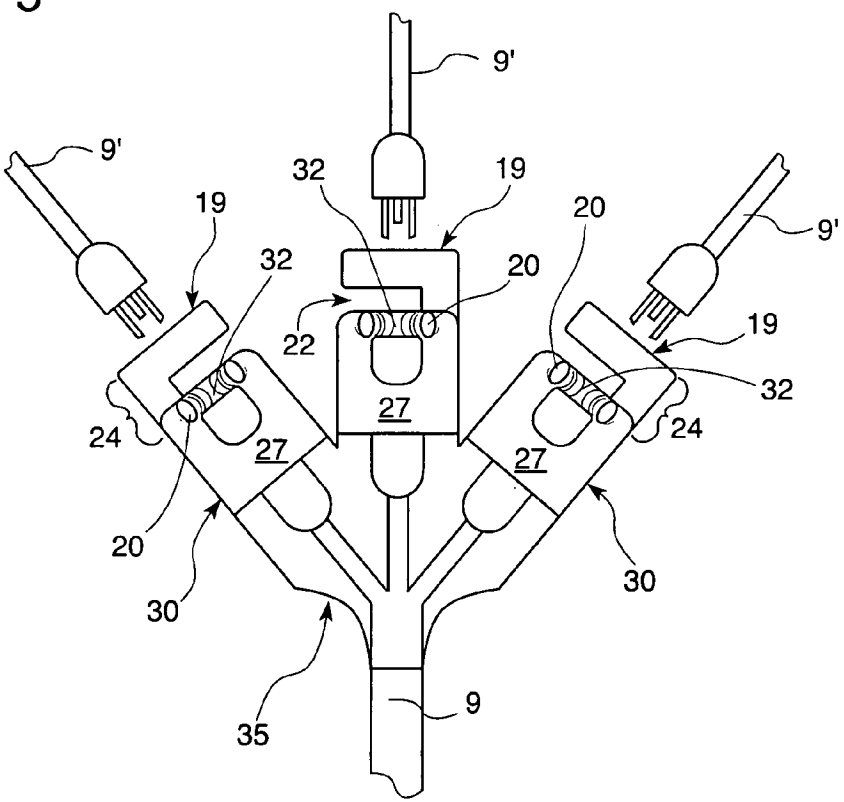
FIG. 5 shows an embodiment of the multi cord holder where the multi cord holder can be attached to more than one extension cord.

FIG. 5 shows a multi cord holder 35 where there are accommodations made for three cords 9' to affix to individual cord holders 30 to form the multi cord holder 35. Although this embodiment shows three attached cords, it should be understood that more or fewer attached cords could be shown. The fixture 24, knobs 20 and fingers 19 function as has been previously discussed. This embodiment fixes the multi cord holder 35 to the cord 9 and would be less likely to be lost.

It should be noted that in some embodiments the cord holder 30 or multi cord holder 35 is attached to the male or female end of the cord 9. The cord holder 30 or multi cord holder 35 could be attached to either end of the cord 9 with either a permanent or sliding attachment 28. The cord holder 30 could also be configured such that either the male or female end is molded into or with the cord holder 30.

It is through this simplistic form of operation that work is performed. It is also apparent that other variations of this device, by incorporating these same principals of operation, may perform like duty (and by these covenants currently disclosed retain a logical lineage). It is therefore requested that application of these embodiments be not held entirely by disclosed device presented here, but also by their equivalents.

What is claimed is:

1. A device for holding the mating ends of separate electrical cords together, the device comprising:

a cord holder, the cord holder having a central bridge and a fixture on each end of the cord holder;

the fixtures each having a pair of knobs extending from the bottom of the bridge forming a downward opening curved area there between, the fixtures having a finger located exterior to the knobs and extending from one side of the bridge towards an opposite side in a radial configuration forming an upward opening saddle located below the bottom there between;

the saddle of the finger and the curved area between the knobs approximately aligned; and the saddle and curved area on each end securing the inserted cords such that the mating ends of the cords can be connected and retained together.

2. A device for holding the mating ends of separate electrical cords together, the device comprising:

a cord holder having an attachment on one end, a bridge in the middle and a fixture on an opposite end, the attachment for affixing the cord holder to the cord, the fixture for removable attachment to a second cord, the fixture having a finger on the end of the cord holder, the finger extending from one side of the bridge in an arcing configuration towards the other side forming an upward opening saddle and gap, a pair of knobs located near the finger and extending from the bottom of the bridge forming an arced downward opening curved area and, the second cord inserted in the gap and saddle and curved area where the end of the second cord is affixed to the end of the first cord.

3. A device for holding the mating ends of separate electrical cords together, the device comprising:

a plurality of cord holders attached to a cord, the cord holders affixed to the end of the cord on one end and having a fixture on the second end, the cord holders arranged for the attachment of a plurality of cords, the fixtures having a finger on the outermost end where the finger extends from one side of the cord holder towards the other side in an arced manner forming an upwardly opening saddle and a gap, a pair of knobs affixed to the bottom of the each cord holder extending downward forming a downward opening curved area, the second cord inserted into the gap of at least one cord holder, the cord housed in the saddle and curved area where the end of the second cord is plugged into the cord holder.

* * * * *